United States Patent [19]

Franklin

[11] 4,309,950

[45] Jan. 12, 1982

[54] EMBROIDERY MACHINE

[75] Inventor: Paul F. Franklin, Cleveland Hts., Ohio

[73] Assignee: Meistergram Inc., Ohio

[21] Appl. No.: 99,087

[22] Filed: Nov. 30, 1979

[51] Int. Cl.[3] ..... D05C 9/06; D05B 21/00

[52] U.S. Cl. ..... 112/103; 112/121.12; 112/275

[58] Field of Search ..... 112/121.12, 275, 121.11, 112/277, 158 E, 102, 103; 318/573

[56] References Cited

U.S. PATENT DOCUMENTS

| | | | |
|---|---|---|---|
| 4,135,459 | 1/1979 | Manabe et al. | 112/121.12 |
| 4,142,473 | 3/1979 | Itoh | 112/158 E |
| 4,220,101 | 9/1980 | Nanai et al. | 112/158 E |

*Primary Examiner*—Peter P. Nerbun

[57] ABSTRACT

An embroidery machine for embroidering a predetermined pattern on fabric includes a sewing head, a cloth frame for supporting fabric to be embroidered with the predetermined pattern for movement relative to the sewing head, first and second drives for moving the cloth frame segmentally in first and second coordinate directions, respectively, and a sewing pattern memory for storing a plurality of signals each of which is representative of an incremental coordinatal displacement of the cloth frame corresponding to individual segments of the predetermined pattern to be embroidered. The embroidery machine further includes a control responsive to the plurality of signals from the sewing pattern memory for actuating the first and second drives and a scaler for modifying the size of the predetermined pattern by modifying the number of segments occasioned in the predetermined pattern by each of the plurality of signals. A smoothing circuit is provided for modifying the segmental displacement of the cloth frame in accordance with the scaler to prevent the exaggeration of jagged edges of the design upon a change in the size of the predetermined pattern. A centering control is also provided for driving the drives to effect movement of the sewing head relative to the fabric to be embroidered around the periphery of the predetermined pattern subsequent to the fabric in the cloth frame being manually centered under the sewing head with respect to the desired central position of the predetermined pattern to be embroidered.

32 Claims, 13 Drawing Figures

EMBROIDERY MACHINE

BACKGROUND OF THE INVENTION

1. Field of the Invention

The present invention relates to an embroidery machine for embroidering a predetermined pattern on fabrics and more particularly to an embroidery machine which includes a smoothing circuit for modifying the segmental displacement of the fabric to be embroidered in accordance with a scaler to smooth undesirable jagged edges of the predetermined pattern which may be accentuated upon a change in size of the predetermined pattern. The machine further includes an inhibit circuit for inhibiting the smoothing means upon the sensing of a predetermined condition and a centering control for moving the cloth frame relative to the sewing head around the periphery of the predetermined pattern to be embroidered subsequent to the fabric being manually centered under the needle with respect to the desired position of the predetermined pattern to be embroidered. A control is also provided to allow the machine to vary the space between distinct spaced apart portions of the pattern to be embroidered in two coordinate directions.

2. Background of the Invention

Automated embroidery machines are known in the art. An example of the known embroidery machines is disclosed in the Ramsey et al U.S. Pat. No. 3,385,244 and in the Scherr U.S. Pat. No. 3,448,705. Both of these patents disclose typical drive systems for driving the fabric of an embroidery machine relative to a sewing head in two coordinate directions, i.e., on X and Y axes.

In many cases it is desired to be able to vary the size of a particular pattern to be embroidered depending on the size of the goods on which the particular pattern is to be embroidered. Generally, the predetermined pattern to be embroidered is represented by signals in a signalling means which need to be modified in order to change the size of the predetermined pattern. In the known machines, the size of the pattern is generally multiplied or divided to scale the pattern. The Reeber, et al U.S. Pat. No. 3,208,414 shows a means for varying the size of the pattern which is a mechanical cam means. In systems such as Reeber's jagged edges of the design will be exaggerated and not smoothed out when the design is expanded. The Bihaly U.S. Pat. No. 3,079,880; the Yanikoski U.S. Pat. No. 3,970,016; and the Muller U.S. Pat. No. 3,938,543 all disclose different control systems for sewing machines, but none discloses means for smoothing the predetermined pattern to be embroidered when the pattern is expanded. Each predetermined pattern consists of a plurality of linear segments. When a pattern in the prior art machines was expanded, generally the individual segments were enlarged according to the desired size of the pattern to be embroidered. Since the prior art machines do not smooth expanded patterns, many times jagged edges of the design are accentuated upon enlargement of the design. An alternative method of scaling without using smoothing would be to store the pattern for the largest size design to be sewn and then divide the pattern to get smaller sizes of the design. While such an approach would not accentuate the jagged edges of the design, it would necessitate a pattern storage capability about 25 times larger than that contemplated with the present design. Of course, it would be possible to have a separate pattern stored for each desired size of the pattern, but this would require an even larger memory.

The present invention overcomes the problems of prior art by providing a smoothing circuit which smoothes jagged edges of the design when the design is expanded. An inhibit circuit is provided for inhibiting the smoothing circuit during certain conditions in which it is not desired to smooth the expanded pattern. Such cases occur when sharp edges of a predetermined pattern are desired such as on a monogram of a letter wherein the corners of the letter are supposed to be distinct.

SUMMARY OF THE INVENTION

The present invention provides a new and improved embroidery machine for embroidering a predetermined pattern on fabric including a sewing head having a reciprocating needle, a cloth frame for supporting fabric to be embroidered with a predetermined pattern for movement relative to the sewing head, first and second drive means for moving the cloth frame segmentally in first and second coordinate directions, respectively, and sewing pattern storage means for storing a plurality of signals each of which is representative of an incremental coordinate displacement of the cloth frame corresponding to an individual segment of the predetermined pattern to be embroidered on the fabric supported by the cloth frame. The plurality of signals each represent a single segmental displacement of the cloth frame in at least one of the first and second coordinate directions and the plurality of signals and plurality of single segmental displacements occasioned thereby represent the predetermined pattern to be embroidered. A control means is provided responsive to the plurality of signals for actuating the first and second drive means and a scaler is provided for operating on the plurality of signals to modify the size of the predetermined pattern to be embroidered by modifying the number of segments occasioned in the predetermined pattern by each of the plurality of signals. A smoothing means is provided responsive to the plurality of signals for modifying the segmental displacement of the cloth frame in accordance with the scaler means to prevent exaggeration of the jagged edges of the design upon a change of the size of the predetermined pattern by the scaler means.

Another provision of the present invention is to provide a new and improved embroidery machine as set forth in the preceding paragraph further including inhibit means for inhibiting the smoothing means upon the sensing of a predetermined condition.

Still another provision of the present invention is to provide a new and improved embroidery machine as set forth in the next preceding paragraph further including a centering control means for moving the cloth frame around the periphery of the predetermined pattern to be embroidered subsequent to the fabric in the cloth frame being manually centered under the needle with respect to the desired position of the predetermined pattern to be embroidered. The centering control means includes a needle inhibit circuit to prevent reciprocation of the needle during movement of the cloth frame. The centering control allows the needle to move relative to the fabric around the periphery of the predetermined pattern to be stitched by the needle without effecting stitching.

A further provision of the present invention is to provide a new and improved embroidery machine for embroidering a predetermined pattern on fabric including a sewing head having a reciprocating needle, a cloth frame for supporting fabric to be embroidered with a predetermined pattern for movement relative to the sewing head, first and second drives for moving the cloth frame segmentally in first and second coordinate directions, respectively, and sewing pattern storage means for storing a plurality of signals each of which is representative of an incremental coordinate displacement of the cloth frame corresponding to individual segments of the predetermined pattern. The plurality of signals each represents a single segmental displacement of the cloth frame in at least one of the first and second coordinate directions. The plurality of signals and the plurality of single segmental displacements occasioned thereby represent the predetermined pattern to be embroidered. The machine further includes a control responsive to the plurality of signals for actuating the first and second drive means and a centering control means responsive to the signals and having an output for driving the first and second drive means to move the cloth frame to effect movement of the needle relative to the fabric to be embroidered around the periphery of the predetermined pattern to be embroidered subsequent to the fabric in the cloth frame being manually centered under the needle with respect to the desired central position of the predetermined pattern to be embroidered.

A still further provision of the present invention is to provide a new and improved embroidery machine for embroidering a predetermined design having at least first and second distinct spaced-apart portions to be embroidered on fabric including a sewing head having a reciprocating needle, a cloth frame for supporting fabric to be embroidered with a predetermined pattern for movement relative to the sewing head, first and second drive means for moving said cloth frame segmentally in first and second coordinate directions, respectively, and sewing pattern storage means for storing a plurality of signals each of which is representative of an incremental coordinate displacement of the cloth frame corresponding to an individual segment of the predetermined pattern to be embroidered on the fabric. The plurality of segments each representing a single segmental displacement of the cloth frame in at least one of the first and second coordinate directions and the plurality of signals and the plurality of single segmental displacements occasioned thereby represent the predetermined pattern to be embroidered. A control means is provided responsive to the plurality of signals in the sewing pattern storage means for actuating the first and second drive means. The control means includes a spacing control means responsive to the plurality of signals for actuating the first and second drive means to move the cloth frame and inhibit the reciprocation of the needle to space apart the first and second distinct spaced-apart portions of the predetermined pattern. The spacing control means is operable to vary the spacing between the first and second distinct spaced-apart portions of the predetermined pattern in both the first and second coordinate directions.

DESCRIPTION OF THE EMBODIMENT

Figure 1:
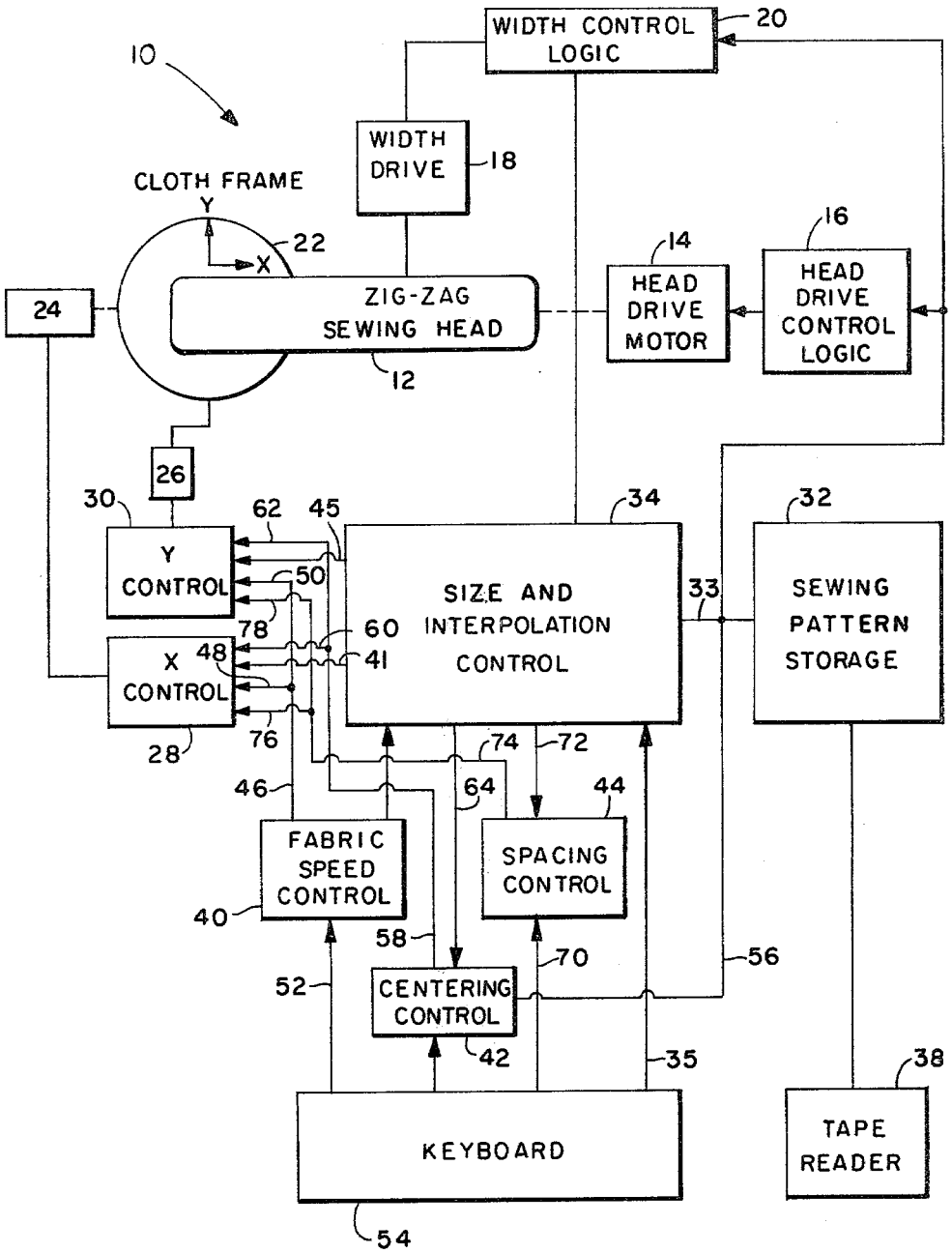
FIG. 1 is a schematic illustration of an embroidery machine embodying the control of the present invention.

Referring to the drawings and more particularly to FIG. 1, an embroidery machine 10 is illustrated for embroidering on fabric. While the machine 10 is described as embroidering on fabric, it should be appreciated that the machine could embroider on leather, plastic, etc. The embroidery machine includes a sewing head 12 which is driven by a head drive motor 14. The head drive motor 14 is controlled by a head drive control logic circuit 16. The logic circuit 16 effects energization of the head drive motor 14 to effect stitching of the sewing head 12. The logic circuit 16 also effects energization of a brake circuit, not illustrated, to effect stopping of the head drive motor 14 in response to a command and a "needle-up circuit," also not illustrated. The "needle-up circuit" is preferably a standard magnetic or photo optic sensing circuit which senses whether the needle is in an up or down position. The logic circuit 16 and the "needle-up circuit" sense when the needle is down during a predetermined condition and ensure that the needle is moved up by engaging a clutch, not illustrated, on a low speed head motor, not illustrated, which raises the needle. The "needle-up circuit" operates to ensure that the needle is up when predetermined conditions are sensed such as upon completion of the predetermined pattern to be embroidered or during spacing of distinct portions of the design such as between letters to be monogramed.

The sewing head 12 of the embroidery machine is preferably a constant speed zig-zag sewing head. A width drive motor 18 is provided for controlling the width of the zig-zag stitching of the sewing head 12 in accordance with a signal from a width control logic 20. The width control logic 20 effects energization of the width drive motor 18 to vary the width of the zig-zag stitches generated by the sewing head 12.

A cloth frame 22 is located beneath the zig-zag sewing head 12. The cloth frame 22 is adapted to support fabric to be embroidered in a well-known manner. The cloth frame 22 is operable to move in two coordinate directions, i.e., in an X direction and in a Y direction, as illustrated, relative to the reciprocating sewing head 12 which is fixed in both the X and Y directions. A stepping motor 24 is provided for moving the cloth frame 22 in incremental steps in an X direction and a stepping motor 26 is provided for moving the cloth frame 22 in incremental steps in the Y direction. The stepping motor 24 is energized by an X control 28 and the stepping motor 26 is energized by a Y control 30 to respectively effect segmental displacement in the X and Y directions of the cloth frame 22 and the fabric supported thereby.

The X and Y controls 28 and 30 are driven by a sewing pattern storage means 32. The sewing pattern storage means 32 is operable to store a plurality of signals therein each of which represents an incremental movement of the cloth frame in the X or Y coordinate directions. The plurality of the segments represented by the signals in the sewing pattern storage means are indicative of the predetermined pattern to be embroidered on the fabric. The signals from the sewing pattern storage means 32 are modified by a size and interpolation control 34 prior to being directed to the X and Y controls 28 and 30 along lines 41 and 45, respectively. A suitable input means such as the tape reader 38 is used to input patterns to the sewing pattern storage means 32. While a tape reader 38 has been illustrated it should be appreciated that various other input means such as magnetic cards, printed circuit boards, keyboards, etc., could be utilized.

The X and Y controls 28, 30 also include inputs from a fabric speed control 40, a centering control 42 and a spacing control 44.

The fabric speed control 40 controls the speed of the incremental movement of the cloth frame 22 in the X and Y directions. The fabric speed control 40 includes an output line 46 which is directed to an input 48 of the X control and an input 50 of the Y control 30. The fabric speed control 40 also includes an input on line 52 from a keyboard 54. The keyboard 54 is utilized to manually enter commands to the fabric speed control 40 over the line 52. The fabric speed control 40 basically consists of a well-known clock circuit which provides a plurality of clocking pulses on the lines 48 and 50 to the X and Y controllers 28 and 30 to effect actuation thereof. The speed of the clocking pulses is controlled by the input from the keyboard 54.

The fabric speed control 40 allows the operator of the machine to compensate for a variety of materials to be embroidered. It is necessary with some materials to vary the density of the stitching or, in other words, to vary the space between the individual stitches occasioned by each segmental displacement of the cloth frame 22. The density of the stitches can be controlled by varying the stitching speed of the sewing head 12 or by varying the speed of the movement of the cloth frame 22. In the preferred embodiment, the sewing head 12 moves at a constant speed and the cloth frame moves at a speed which is variable. Moving the fabric at a predetermined speed by the cloth frame 22 results in a predetermined density of stitches. If the fabric is moved faster by the fabric speed control 40, the space between stitches increases and the density of the pattern is decreased. If the cloth frame 22 is incrementally moved slower, the space between the successive stitches will decrease and the density of stitches will increase. The fabric speed control 40 will not vary the path followed by the cloth frame 22 but will only vary the speed at which the cloth frame is incrementally moved by the X and Y stepping motors 24 and 26.

The centering control 42 is operable to effect movement of the cloth frame 22 relative to the needle to move the needle around the periphery of the predetermined pattern to be embroidered subsequent to the cloth frame 22 and fabric supported thereby being manually centered with respect to the needle by an operator of the machine. The centering control 42 is utilized to outline a design to determine whether the design will fit in an allotted space. To this end, the centering control 42 directs a signal along line 56 to the head drive control logic 16 to inhibit reciprocation of the sewing head 12. The centering control 42 then moves the cloth frame 22 from the manually located center of the design to the starting point and sequentially traces an outline of a box around the complete design without sewing. The operator can then see whether the design fits in the allocated space. The box around the complete design around which the centering control 42 effects movement of the cloth frame 22 is determined by the maximum X and Y coordinate displacements from the sewing pattern storage means 32 and the size and interpolation control 34.

The centering control 42 includes an output 58 which is directed to an input 60 to the X control 28 and an input 62 to the Y control 30. The signals directed along lines 58, 60 and 62 effect movement of the cloth frame 22 around the periphery of the pattern. The centering control 42 also includes an input on line 64 from the size and interpolation control. The signals on line 64 are indicative of the predetermined design to be embroidered as represented by the signals stored in the sewing pattern storage 32 and the size of the design as scaled by the size and interpolation control 34. The centering control 42 automatically determines the starting point of the predetermined pattern to be embroidered subsequent to the cloth frame 22 being manually located to position the needle at the desired center point of the design. The centering control 42 determines the starting point of the entire design from the signals in the sewing pattern storage 32 which are modified by the size and interpolation control 34 and moves the cloth frame 22 from its manually located center position to the starting point of the predetermined pattern to be embroidered. The control takes into account the shape of the design and the size to automatically move the cloth frame 22 to the starting point for the predetermined pattern to be embroidered.

The spacing control 44 is utilizable when monograming (sewing letters) or sewing a predetermined pattern which consists of distinct spaced apart portions. The spacing control 44 allows the spacing between the letters or distinct portions of the design to be controlled and varied in both the X and Y coordinate directions in response to instructions entered into the keyboard 54. The spacing control 44 includes an input on line 70 from the keyboard 54. The input on line 70 is representative of the desired X and Y spacing between the distinct portions of the design. The spacing control 44 also includes an input on line 72 from the size and interpolation control 34. The input on line 72 is indicative of the size and design to be embroidered. The spacing control 44 operates on the signals on lines 70 and 72 and establishes a signal on line 74 which is directed to an input 76 of the X control 28 and an input 78 of the Y control 30. The output from the spacing control 44 controls the spacing between distinct portions of the pattern to be embroidered in the X and Y directions.

The spacing control 44 examines each letter to be monogramed or each distinct portion of the design to be embroidered from the information on line 72 and establishes a rectangle around the letter or distinct portion of the design whose height is the size of the tallest portion of the design and whose width is the width of the widest point in the design. The spacing control then derives a starting point which, in the preferred embodiment, is the lower left-hand corner of the rectangle and a finish point which is the lower right-hand corner of the rectangle in the preferred embodiment. The spacing between the successive rectangles around successive letters or successive parts of the design is determined by the input on line 70 from the keyboard 54. When the machine arrives at a finish point for a particular letter or a particular portion of a pattern, it moves over the horizontal spacing and the vertical spacing inputted to the spacing control 44 on the line 70 before starting the next subsequent letter or portion of the pattern to be embroidered. By this means, the spacing between successive distinct portions of the pattern to be embroidered or successive letters can be controlled in both a vertical and horizontal direction.

Figure 2:
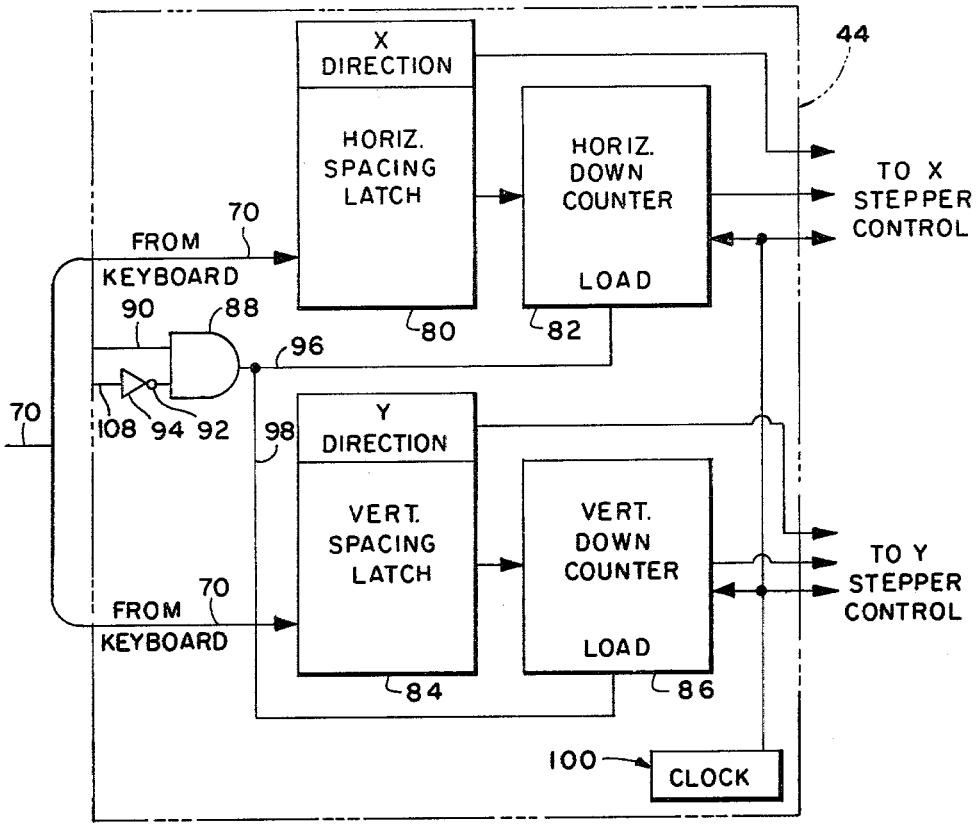
FIG. 2 is a more detailed schematic illustration of the spacing control of FIG. 1.

The spacing control 44 is more fully illustrated in FIG. 2. The spacing control 44 includes a horizontal, or X direction, spacing latch 80 having an output connected to a horizontal down counter 82 and a vertical spacing, or Y direction, latch 84 having an output connected to a vertical down counter 86. The horizontal spacing latch 80 and vertical spacing latch 84 each include an input on line 70 from the keyboard 54. The input on line 70 is indicative of the desired spacing between letters or predetermined portions of the pattern to be monogrammed. The desired spacing is stored for the X direction in the horizontal spacing latch 80 and in the Y direction in the vertical spacing latch 84. An AND gate 88 is provided which includes a pair of inputs 90,92 which receive signals from the line 72 from the size and interpolation control 34. The input 90 is an end-of-pattern input which signifies that the cloth frame 22 has finished moving around a first portion of a predetermined design to be embroidered. The input 92 is directed to the AND gate 88 through an inverting amplifier 94 and establishes a signal to the AND gate 88 upon completion of the predetermined pattern to be embroidered. The signal directed to the inverting amplifier 94 is on line 108 from a control word separator 102 which will be more fully described below. When the end of a portion of the pattern to be embroidered occurs, an input will be established on line 90 (also from the control word separator 102) which will be directed through the AND gate 88 (assuming that the end of the entire pattern to be embroidered is not sensed on line 92) to lines 96 and 98 to effect loading of the horizontal down counter 82 and vertical down counter 86 with the signals in the horizontal spacing latch 80 and the vertical spacing latch 84, respectively. A clock 100 is provided for clocking the horizontal and vertical down counters 82, 86. The clock 100 runs at the maximum speed of the stepping motors and is not keyed to the fabric speed control 40 due to the fact that the needle is in its up position when moving between predetermined portions of the pattern. When the end of a predetermined portion of a pattern is sensed on line 90, the horizontal down counter 82 and the vertical down counter 86 will effect pulsing of the X stepping control and the Y stepping control 28 and 30 at a speed dependent upon the speed of the clock 100 for a time period determined by the signals stored in the horizontal spacing latch and the vertical spacing latch 84. Upon the sensing of the end of a pattern on line 92, a signal will be established through AND gate 88 to the horizontal and vertical down counters 82, 86 to disable the counters 82, 86 after the last portion of the pattern has been embroidered to prevent an extra move at the end of the pattern.

Figure 3:
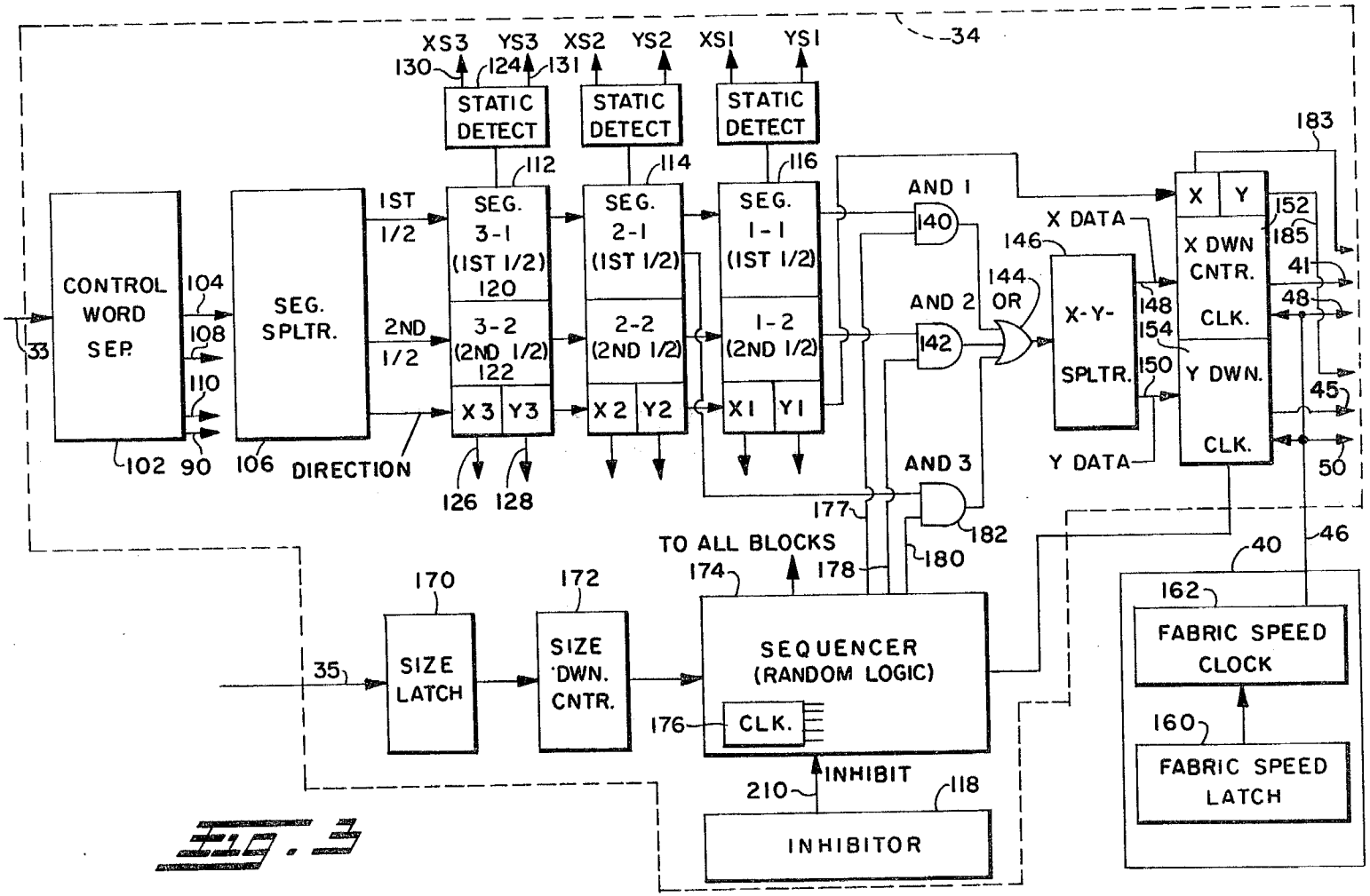
FIG. 3 is a schematic illustration of the smoothing control of the present invention.

The size and interpolation control 34 is more fully disclosed in FIG. 3. The input to the size and interpolation control 34 is along the line 33 from the sewing pattern storage means 32. The input on line 33 will include segment data indicative of the desired movement in the X and Y direction of the cloth frame 22 and a plurality of control words which will control different functions of the machine at predetermined points in the operation.

The data on line 33 is directed to a control word separator 102 which separates the segment data from the control words and directs the segment data along line 104 to a segment splitter 106. The control word separator 102 separates the control words from the information on line 33 and directs them to the outputs 90, 108 and 110 and then to the proper devices in the machine 10 which need be controlled. The output 90 will have a signal thereon indicating the end of a predetermined portion of a design such as the end of a single letter in a multi-letter monogram. The output 108 will have a signal thereon indicative of the end of embroidering a predetermined pattern. The signal on line 108 is used to stop the machine upon completion of a predetermined pattern. The output 110 will direct control words along line 56 to the head drive and width control logic to control the energization of the sewing head 12 and the width of the stitching as controlled by the width drive motor 18. Additional outputs from the control word separator 33 can be used to control other functions of the machine 10 such as changing thread size or color in dependence upon control word instruction entered into the machine.

The segment data from the control word separator is passed on line 104 to a segment splitter 106 which divides each segment into a first half and a second half and also separates direction information from the segment signals. The segment splitter 106 directs its outputs to segment latches 112, 114 and 116. The segment latches 112, 114, and 116 provide a three segment buffer for use by an inhibit circuit 118. The segment latch 112 includes a first portion 120 for storing the first half of a segment therein, a second portion 122 for storing the second half of a segment therein, a static detect circuit 124 and a pair of direction outputs 126, 128. The static detect circuit detects whether there is motion on only one axis of a particular segment to determine if the particular segment is static. For example, a given segment is said to be static on the Y axis if during that segment there is no motion on the X axis. The static detect circuit 124 includes a pair of outputs 130 and 131 for respectively indicating whether the first and second half segments stored in the counter 112 are static on their X axis or their Y axis. The outputs 130, 131 are directed to the inhibit circuit 118 as will be more fully described hereinbelow. The outputs from the direction logic on lines 126 and 128 are indicative of the direction of the segments stored in the latch 112. The outputs on lines 126 and 128 are directed to the inhibit logic 118 as will be discussed more fully below. Each of the other segment latches 114, 116 includes similar static detect circuits, direction circuits, and segment storage portions for storing the first and second halves of the successive segments split by the segment splitter 106.

The segments from the segment splitter 106 are shifted through the segment latches 112, 114 and 116 in sequence to enable the inhibit logic 118 to determine whether an inhibit condition occurs. When the segment latches are loaded and shifted, the segment in the first portion of the latch 116 is directed to the X and Y control to effect movement of the frame 22. The segment in the first portion of the segment latch 114 is then shifted into the first portion of the segment latch 116 and the segment in the second portion of the latch 114 is shifted to the second portion of the latch 116. In a similar manner, the segments stored in the latch 112 are shifted to the portions of the latch 114. A new signal is loaded from the segment splitter 106 to the segment latch 112 when shifting occurs. The signals stored in the latches 112, 114 and 116 are indicative of successive segments to be embroidered by the sewing head 12.

The signals from the output of the latch 116 are directed through AND gates 140, 142 through an OR gate 144 to an X-Y splitter 146. The X-Y splitter takes the output from the OR gate 144 and directs it either to an X data line 148 or a Y data line 150 to respectively load an X down counter 152 or a Y down counter 154. The signals stored in the X down counter 152 and the Y down counter 154 are directed along lines 32 and 34, respectively, to the X and Y stepper controls 28 and 30 to effect segmental movement of the cloth frame in the desired segmental increments.

The frequency of the signals from the X down counter 152 and the Y down counter 154 and the speed of fabric movement are controlled by the fabric speed control 40 which includes a fabric speed latch 160 and a fabric speed clock 162. The fabric speed latch 160 is set by an input from the keyboard 54 and controls the frequency of the clock signals from the clock 162 to the X and Y counters 152, 154. The fabric speed clock 162 directs its output along line 46 to lines 48 and 50 which respectively pulse the X down counter 152 and the X stepper control 28 and the Y down counter 154 and Y stepper control 30. The frequency of the clock signals controls the speed at which the X and Y counters 152, 154 actuate the X and Y controls 28, 30 to thereby control the speed of incremental movement of the cloth frame 22. Controlling the speed of incremental movement of the cloth frame 22 controls the density of the stitches.

The size and interpolation control 34 also includes an input on line 35 from the keyboard 54 which controls the size of the pattern to be embroidered. The sewing pattern storage means 32 includes signals therein representative of a predetermined pattern to be embroidered. The signals are representative of the smallest sized pattern to be embroidered by the signals stored in the sewing pattern storage means 32. The operator can vary the size of the pattern to be embroidered by sequentially repeating the signals indicative of a predetermined pattern in the sewing pattern storage means 32. For example, if the size of the pattern is to be doubled from the standard size set in the sewing pattern storage means 32, then each step or incremental movement of the cloth frame 22 will be repeated twice. If it is desired to triple the size of the design stored in the sewing pattern storage means 32, then each signal can be repeated three times.

The signal on line 35 from the keyboard 54 is directed to a size latch 170 and a size down counter 172 to a sequencer 174 which controls the sequence of signals passed from the segment latches to the X-Y splitter 146. The size latch 170 is set by a signal from the keyboard and controls the count in the size down counter 172 to effect the aforementioned repeating of signals to vary and control the size of the predetermined pattern to be embroidered. The sequencer 174 includes a clock 176 therein which supplies clock pulses on lines 177, 178 and 180 to clock AND gates 140, 142 and 182 and, hence, controls the speed at which information is passed to the X and Y stepper controls. The sequencer 174 also controls the repeatability and sequence of the segmental information stored in the latches 112, 114 and 116 which are directed to the X and Y controls 28 and 30 to thereby control the size of the pattern to be embroidered.

When a new pattern is first loaded into the latches 112, 114 and 116, the sequencer 174 sequentially shifts the first three segments of the pattern to be embroidered into the segment latches 112, 114 and 116. At this point in time, the AND gate 140 is enabled by the sequencer 174 to pass the first half of the segment in latch 116 to the X-Y splitter 146 which separates the horizontal and vertical data and passes it to the down counters 152, 154. The counters 152, 154 begin sending pulses indicative of movement of the cloth frame 22 through a path determined by the first half of the segment stored in the first portion of latch 116 to the stepping motor controls 28, 30 at a rate determined by the fabric speed clock 162. The stepping motor direction is set by the direction output on lines 183, 185.

The sequencer 174 causes the first half of the segment in 116 to be repeated a predetermined number of times depending on the desired size of the pattern to be embroidered which is determined by the data in the size latch 170 and down counter 172 as discussed hereinabove. After repeating the first half of the segment in latch 116 a predetermined number of times, the sequencer 174 then checks the inhibit circuit 118 to determine if an inhibit condition exists. If the inhibit circuit 118 has a false output, indicating no inhibit condition, the sequencer 174 will pass the second half of the first segment stored in 116 and then the first half of the segment stored in 114. The second half of the segment stored in latch 116 and the first half of the segment stored in latch 114 will be repeated as a unit a predetermined number of times determined by the data in size latch 170 and the size down counter 172. After that is accomplished, the sequencer 174 will shift the segments in latches 112, 114 and 116. Upon shifting, the first half of the segment in the first portion of latch 114 will be directed to the first portion of the latch 116 and the second half of the segment in the second portion of latch 114 will be directed to the second portion of the latch 116. Likewise, the first half of the segment in the first portion 120 of latch 112 will be directed to the first portion of the latch 114 and the second half of the segment in the second portion 122 of latch 112 will be directed to the second portion of the latch 114. The next sequential split segment from the segment splitter 106 will then be fed into the first and second portions of the latch 112 as the data is shifted between latches 112, 114 and 116.

If a true inhibit signal is sensed by the sequencer 174 from the inhibit circuit 118, then the first and second halves of the segment stored in 116 will be embroidered and sewn to size per the data in latch 170. The segments from the splitter 106 would then be shifted through the latches 116, 114 and 112 as discussed hereinabove. The sequencer 174 would then look to again determine whether the inhibit signal was true from the inhibit circuit 118. If a true inhibit occurred, then the first and second halves of the segment in latch 116 would be repeated per the size data in latch 170. If the output from the inhibit circuit 118 were false, then the latches 112, 114 and 116 would operate to repeat the first half of the segment in latch 116 per size and combine the second half of the segment in latch 116 with the first half of the segment in latch 114 and repeat the newly formed segment per the size data in the size latch 170. At this time the data in latch 112, 114 and 116 will be shifted and the process repeated. Such a method of operation will prevent the exaggeration of undesirable jagged edges of the design when the design is expanded from the minimum size stored in the sewing pattern storage means 32.

However, in certain instances it is desired not to smooth the design. These instances occur when sharp corners in the design are designed such as corners on letters, etc. The inhibit circuit 118 senses the occurrence of the inhibit conditions and prevents the interpolation control 34 from smoothing by forming new segments from the second part of one segment and the first portion of a subsequent segment.

The inhibit circuit and the conditions causing an inhibit are more fully disclosed in FIGS. 4–7.

Figure 4:
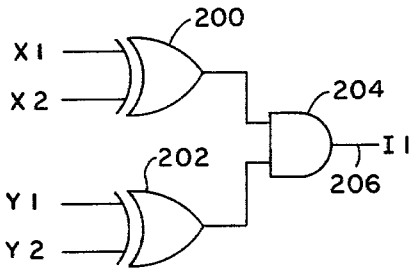
FIG. 4 is a schematic illustration of one of the inhibit circuits of the present invention and FIG. 4(*a*) is a pictorial illustration of a pattern which would effect actuation of the inhibit circuit of FIG. 4.
Figure 4A:
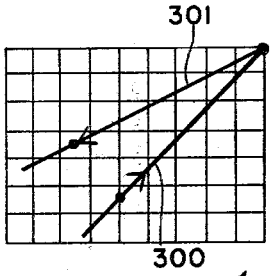
Figure 8:
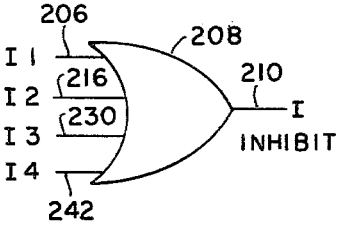
FIG. 8 is a schematic illustration of the inhibit circuit actuated by the inhibit circuits of FIGS. 4–7.

The FIG. 4 inhibit circuit establishes an inhibit signal if both axes of sequential segments change direction. Such a case is pictorally represented in FIG. 4A where both axes of sequential segments 300 and 301 change direction. The inhibit circuit of FIG. 4 includes a pair of exclusive OR gates 200 and 202. An output from the exclusive OR gate 200 will be established when the direction of the segment represented by $X_1$ in the latch 116 is different from the direction of the segment represented by $X_2$ in latch 114. Similarly, an output from the exclusive OR gate 202 will be established if the direction of the segment represented by $Y_1$ in the latch 116 is different from that of the direction of the segment represented by $Y_2$ in the latch 114. An output from both exclusive OR gates 200 and 202 will cause an AND gate 204 to direct an inhibit signal $I_1$ along line 206. As illustrated in FIG. 8, line 206 is directed to an OR gate 208 which establishes an inhibit signal on the output 210 thereof to inhibit the smoothing operation.

Figure 5:
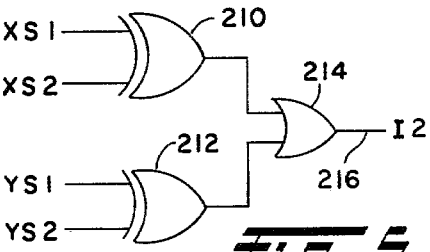
FIG. 5 is a schematic illustration of another inhibit circuit of the present invention and FIG. 5(*a*) is a pictorial illustration of a pattern which would effect actuation of the inhibit circuit of FIG. 5.
Figure 5A:
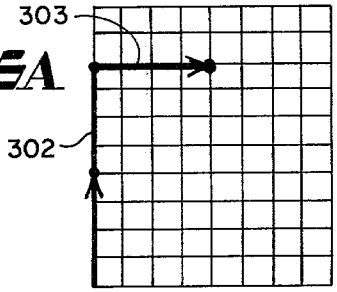

The inhibit circuit of FIG. 5 establishes an inhibit output when a different axis is static before and after a particular segment. Such a case is pictorally represented in FIG. 5A where the Y axis is static for one segment 302 and the X axis is static in the sequential segment 303. The inhibit circuit of FIG. 5 includes a pair of exclusive OR gates 210 and 212. An output is established from the exclusive OR gate 210 if the X direction of one of the segments stored in latches 116 and 114 is static and one is not. An output is established from the exclusive OR gate 212 if one of the segments in latches 116 and 114 is static in the Y direction and one is not. An output from either of the exclusive OR gates 210 and 212 causes an OR gate 214 to establish an output on line 216. Line 216 is directed to the OR gate 208 shown in FIG. 8 to establish an inhibit signal to inhibit smoothing.

Figure 6:
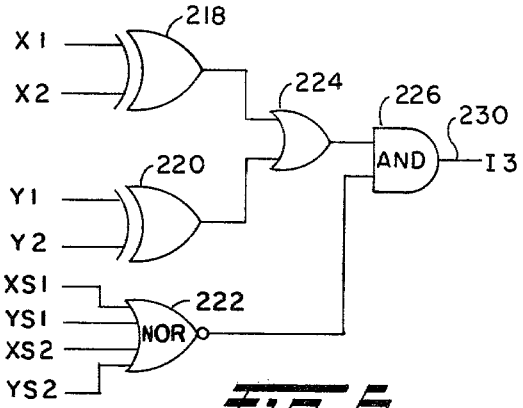
FIG. 6 is a schematic illustration of another inhibit circuit of the present invention and FIG. 6(*a*) is a pictorial representation of a pattern which would effect actuation of the inhibit circuit of FIG. 6.
Figure 6A:
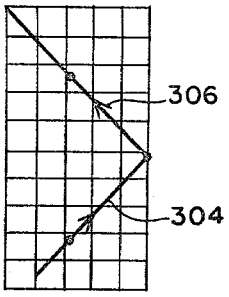

The inhibit circuit of FIG. 6 establishes an inhibit signal when there is a direction change in sequential segments with neither axis static in the sequential segments. Such a situation is illustrated in FIG. 6A wherein neither the X nor Y axis is static for sequential segments 304, 306. The inhibit circuit of FIG. 6 includes a pair of exclusive OR gates 218, 220, a NOR gate 222, an OR gate 224 and an AND gate 226. An output is established from one of the exclusive OR gates 218 or 220 if the direction of the X or Y segments, respectively, is not the same in the latches 114 and 116. An output from either of the exclusive OR gates 218, 220 will establish an output from the OR gate 224 to the input of the AND gate 226. An output is established from the NOR gate 222 when none of the segments in the latches 114, 116 are not static in either the X or Y directions. When this occurs, a high output will be established from the NOR gate 222 to condition the AND gate 226 to pass a signal from the OR gates 218, 220. AND gate 226 will only conduct when a high signal is received from NOR gate 222 and an output is received from the OR gate 224. The output of AND gate 226 is directed along line 230 to the input of the OR gate 208 of FIG. 8 to inhibit the smoothing operation.

Figure 7A:
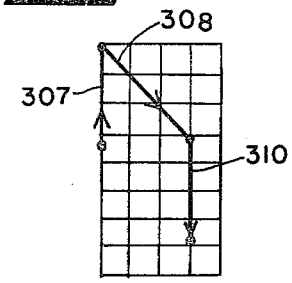
FIG. 7 is a schematic illustration of another inhibit circuit of the present invention and FIG. 7(*a*) is a pictorial representation of a pattern which would effect actuation of the inhibit circuit of FIG. 7.
Figure 7:
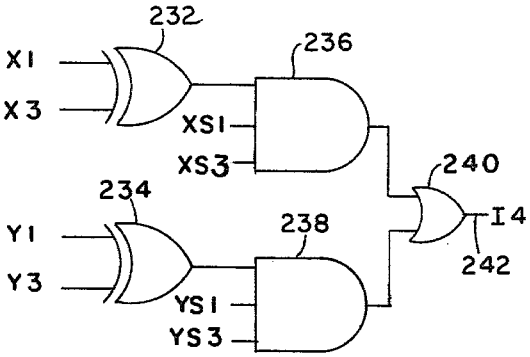

The inhibit circuit of FIG. 7 establishes an inhibit output when there is a direction change on the static axis of sequential segments. Such a condition is illustrated in FIG. 7A where there is a direction change in the static Y direction of sequential segments 307 and 310. The inhibit circuit in FIG. 7 includes a pair of exclusive OR gates 232, 234 which have their outputs respectively directed to AND gates 236 and 238. The exclusive OR gate 232 establishes an output when the X direction of the segment in latch 116 is different from the X direction of the segment in latch 112 and the exclusive OR gate 234 establishes a signal to the AND gate 238 when the Y direction of the segment in latch 116 is different from the Y direction of the segment in latch 112. The AND gate 236 also includes inputs from the X static detectors for the latches 116 and 114 and the AND gate 238 includes inputs from the Y static detectors of the segments in latches 116 and 112. An output from either of the AND gates 236 or 238 will effect an output through the OR gate 240 to establish a signal on line 242 indicative of a direction change in the static axis. The signal on line 242 will be directed to an input of the inhibit OR gate 208 of FIG. 8.

It should be appreciated that the output of the inhibit OR gate 208 is directed along 210 of the inhibit circuit 118 to establish an inhibit input to the sequencer 174 upon the occurrence of one of the listed predetermined conditions. The inhibit circuit prevents the operation of the size and interpolation control 34 to smooth jagged edges of the design during the occurrence of predetermined inhibit conditions. These inhibit conditions generally occur when it is desirable to have sharp edges on the design.

Figure 9:
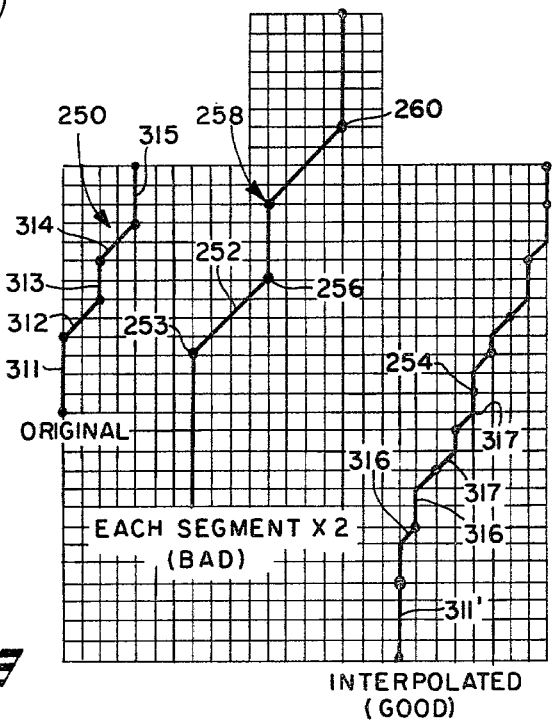
FIG. 9 is a pictorial representation of the operation of the smoothing control showing a stored pattern, normal doubling of the stored pattern which exaggerates jagged edges thereof and doubling of size of the original pattern utilizing the smoothing control means.

An example of the operation of the interpolation control 34 is disclosed in FIG. 9. FIG. 9 shows an original portion 250 of a predetermined pattern stored in the storage means 32. The original portion 250 would have a size indicative of the minimum size of the pattern stored in the storage means 32 and is composed of five sequential segments—311, 312, 313, 314, and 315. If it were desired to double the size of the portion 250, the prior art course of action would be to establish the design 252 as shown in FIG. 9 which merely doubles the size of the segments in the original portion. However, it should be appreciated that the jaggedness of the corners 253, 256, 258 and 260 is exaggerated by doubling the size of the original design 250. The interpolation control 34 allows the combining of the different segments to establish the pattern shown at 254. The pattern formed at 254 is formed by doubling the size of the first half of segment 311 as indicated at 311' and then combining the last half of segment 311 with the first half of segment 312 and then repeating this twice as segments 316. Similarly, the second half of segment 312 is combined with the first half of segment 313 and repeated twice as 317. The process is repeated until the design is doubled. It can be seen that the corners of the pattern are smoother in the design shown at 254 that in the design shown at 256. This will accord a more tailored look to the design to be embroidered and will give the edges of the design a smoother less jagged look. It should be appreciated that the representations in FIG. 9 are schematic and disclose a plurality of single sequential segments which are repeated per size to establish the predetermined pattern. These segments are exaggerated for the purposes of the drawing and in actuality the distinctness of the segments between successive segments will not be readily apparent. Accordingly, the smoothing function occasioned by the interpolation control will result in a line which is relatively smooth. Each of the individual segments are small enough that curves and other intricacies of the desired pattern can be closely approximated and smoothed without exaggerated jagged edges of the design.

From the foregoing it should be apparent that a new and improved embroidery machine has been provided. The embroidery machine includes a sewing head 12 having a reciprocating needle therein which generally reciprocates at a fixed speed. A cloth frame 22 supports fabric to be embroidered for movement relative to the sewing head 12. An X drive 24 and a Y drive 26 are provided for moving the cloth frame 22 segmentally in X and Y coordinate directions and a sewing pattern storage means 32 is provided for storing a plurality of signals each of which represents a desired incremental displacement of the cloth frame corresponding to individual segments of the predetermined pattern to be embroidered. The plurality of signals stored in the sewing pattern storage means 32 represent the predetermined pattern to be embroidered on the fabric. The embroidery machine includes a size and interpolation control 34 for actuating the X stepping motor and Y stepping motor 24, 26 and scaler means for operating on the signals from the sewing pattern storage means to modify the number of segments occasioned in the predetermined pattern by each of the plurality of signals. The size and interpolation control 34 includes a smoothing circuit for modifying the segmental displacement of the cloth frame in accordance with the scaler to prevent the exaggeration of jagged edges of the design upon a change in the size of the predetermined pattern by the scaler. The machine further includes a centering control for moving the cloth frame to effect movement of the needle relative to the fabric to be embroidered around the periphery of the predetermined pattern subsequent to the fabric in the cloth frame being manually centered under the needle and a fabric speed control for varying the speed of the incremental movement of the cloth frame 22 to vary the stitching density. A spacing control is also provided to vary the spacing between spaced apart portions of the predetermined pattern to be embroidered in both the X and Y directions. A plurality of inhibit circuits are provided to inhibit the operation of the size and interpolation control 34 upon the sensing of predetermined conditions which indicate that it is not desired to effect smoothing of jagged edges of the design.

I claim:

1. An embroidery machine for embroidering designs on fabric comprising a sewing head having a reciprocating needle driven by a motor, a cloth frame for supporting fabric to be embroidered with a predetermined pattern for movement relative to said sewing head, first and second drive means for moving said cloth frame segmentally in first and second coordinate directions, respectively, to enable said sewing head to segmentally embroider said predetermined pattern on the fabric supported by said cloth frame, sewing pattern storage means for storing a plurality of signals each of which is representative of an incremental coordinate displacement of said cloth frame corresponding to individual segments of said predetermined pattern to be embroidered, said plurality of signals each representing a single segmental displacement of said cloth frame in at least one of said first and second coordinate directions, said plurality of signals and said plurality of single segmental displacements occasioned thereby representing said predetermined pattern to be embroidered, control means responsive to said plurality of signals from said sewing pattern storage means for actuating said first and second drive means, scaler means for operating on said plurality of signals from said sewing pattern storage means for modifying the size of the predetermined pattern to be embroidered by modifying the number of segments occasioned in said predetermined pattern by each of said plurality of signals, and smoothing means responsive to said plurality of signals for modifying the segmental displacements of said cloth frame in accordance with said scaler means to prevent the exaggeration of jagged edges of the design upon a change of size of the predetermined pattern as represented by said plurality of signals in said sewing pattern storage means.

2. An embroidery machine for embroidering a predetermined design on fabric as defined in claim 1 further including sensing means for sensing the direction and coordinate displacement of a plurality of sequential segmental displacements of said predetermined pattern as indicated by said plurality of signals prior to embroidering said plurality of segments occasioned by said plurality of signals and inhibit means for inhibiting said smoothing means upon said sensing means sensing a predetermined condition.

3. An embroidery machine for embroidering a predetermined pattern on fabric as defined in claim 1 further including inhibit means for inhibiting said smoothing means upon a change in direction of successive segments in both said first and second coordinate directions as indicated by said plurality of signals.

4. An embroidery machine for embroidering a predetermined pattern on fabric as defined in claim 1 further including inhibit means for inhibiting said smoothing means when said plurality of signals indicate that segments immediately before and immediately after a particular segment have different coordinate directions static.

5. An embroidery machine for embroidering a predetermined pattern on fabric as defined in claim 1 further including inhibit means for inhibiting said smoothing means when said plurality of signals indicate that there is a direction change in successive segments and neither of said first and second coordinate directions is static.

6. An embroidery machine for embroidering a predetermined pattern on fabric as defined in claim 1 further including inhibit means for inhibiting said smoothing means when said plurality of signals indicate that there is a direction change in successive segments on a static axis in one of said first and second coordinate directions.

7. An embroidery machine for embroidering a predetermined pattern on fabric as defined in claim 1 wherein said smoothing means includes a segment splitter for dividing each segment occasioned by each of said plurality of signals into first and second portions, means for forming new segments from the second portion of one segment and the first portion of the successive segment and means for repeating said new segments in dependence upon said scaler means to vary the size of the predetermined pattern to be embroidered without exaggerating jagged edges of the pattern.

8. An embroidery machine for embroidering a predetermined pattern on fabric as defined in claim 7 further including sensing means for sensing the direction and coordinate displacement of a plurality of sequential segmental displacements of said predetermined pattern as indicated by said plurality of signals prior to embroidering said plurality of segments occasioned by said plurality of signals and inhibit means for inhibiting said smoothing means upon said sensing means sensing a predetermined condition.

9. An embroidery machine for embrodiering a predetermined pattern on fabric as defined in claim 7 further including inhibit means for inhibiting said smoothing means upon a change in direction of successive segments in both said first and second coordinate directions as indicated by said plurality of signals.

10. An embroidery machine for embroidering a predetermined pattern on fabric as defined in claim 7 further including inhibit means for inhibiting said smoothing means when said plurality of signals indicate that segments immediately before and immediately after a particular segment have different coordinate directions static.

11. An embroidery machine for embroidering a predetermined pattern on fabric as defined in claim 7 further including inhibit means for inhibiting said smoothing means when said plurality of signals indicate that there is a direction change in successive segments and neither of said first and second coordinate directions is static.

12. An embroidery machine for embroidering a predetermined pattern on fabric as defined in claim 7 further including inhibit means for inhibiting said smoothing means when said plurality of signals indicate that there is a direction change in successive segments on a static axis in one of said first and second coordinate directions.

13. An embroidery machine for embroidering a predetermined pattern on fabric as defined in claim 1 wherein said reciprocating needle is driven at a substantially constant speed by said motor and said control means further includes fabric speed control means for varying the speed of movement of said cloth frame by said first and second drive means during the stitching of successive segments of the predetermined pattern to vary the density of stitches in said predetermined pattern.

14. An embroidery machine for embroidering a predetermined pattern on fabric as defined in claim 1 further including centering control means for segmentally moving the cloth frame and the fabric to be embroidered to move the needle relative to the fabric around the periphery of said predetermined pattern to be embroidered subsequent to the fabric and the cloth frame being manually centered under the needle with respect to the desired position of the predetermined pattern to be embroidered, said centering control means including a needle inhibit circuit to prevent energization of said motor and the reciprocation of said needle during movement of said cloth frame in response to said centering control means to allow said needle to move relative to the fabric around the periphery of the predetermined pattern without said needle stitching.

15. An embroidery machine for embroidering a predetermined pattern on fabric as defined in claim 1 wherein said predetermined pattern to be stitched comprises a plurality of distinct spaced-apart patterns and further including spacing control means for varying the spacing between said distinct pattern in both of said first and second coordinate directions.

16. An embroidery machine for embroidering a predetermined pattern on fabric as defined in claim 1 further including starting control means for moving said cloth frame to position said needle adjacent to the desired starting position on the fabric at which the stitching of the predetermined pattern is initiated subsequent to the fabric and said cloth fame being manually centered with respect to said needle at the desired center of the predetermined pattern.

17. An embroidery machine for embroidering a predetermined pattern on fabric as defined in claim 8 wherein said smoothing means further includes first, second, and third latches responsive to said segment splitter and each of which stores a pair of signals therein representative of first and second portions of segments which have been split by said segment splitter, said first, second and third latches storing signals therein representative of the coordinate displacement of successive segments, said sensing means sensing said pair of signals in each of said first, second and third latches to determine if an inhibit condition exists.

18. An embroidery machine for embroidering a predetermined pattern on fabric as defined in claim 17 wherein said inhibit means further includes a first inhibit circuit for inhibiting said smoothing means when the direction of the segments stored in said first latch in said first and second coordinate directions is different from the direction of the segment stored in said second latch in said first and second coordinate directions indicative of a change in direction in both said first and second coordinate directions between successive segments stored in said first and second latches.

19. An embroidery machine for embroidering a predetermined pattern on fabric as defined in claim 18 wherein said inhibit means further includes a second inhibit circuit for inhibiting said smoothing means when the direction of the segment stored in said first latch or said third latch is static in said first coordinate direction or the direction of the segment stored in said first latch or said third latch is static in said second coordinate direction which is indicative of a different coordinate being static for the direction of said segments stored in said first and third latches.

20. Am embroidery machine for embroidering a predetermined pattern on fabric as defined in claim 19 wherein said inhibit means further includes a third inhibit circuit for inhibiting said smoothing means when the direction of the segment stored in said first latch in said first coordinate direction is different from the direction of the segment stored in said second latch in said first coordinate direction or the direction of said segment stored in said first latch in said second coordinate direction is different from the direction of the segment stored in said second latch in said second coordinate direction and none of the segments stored in said first and second latches are static in said first or second coordinate directions.

21. An embroidery machine for embroidering a predetermined pattern on fabric as defined in claim 20 wherein said inhibit means further includes a fourth inhibit circuit for inhibiting said smoothing means when the direction of the segment stored in said first latch in said first coordinate direction is different from the direction of the segment stored in said third latch in said first coordinate direction and the direction of said segments in said first and third latches is static in said first coordinate direction or when the direction of segment stored in said first latch in said second coordinate direction is different from the direction of the segment stored in said third latch in said second coordinate direction and the direction of said segments in said first and third latches is static in said second coordinate direction.

22. An embroidery machine for embroidering a predetermined pattern on fabric comprising a sewing head having a reciprocating needle driven by a motor, a cloth frame for supporting fabric to be embroidered with a predetermined pattern for movement relative to said sewing head, first and second drive means for moving said cloth frame segmentally in first and second coordinate directions, respectively, to enable said sewing head to segmentally embroider said predetermined pattern on the fabric supported by said cloth frame, sewing pattern storage means for storing a plurality of signals each of which is representative of an incremental coordinate displacement of said cloth frame corresponding to individual segments of said predetermined pattern to be embroidered, said plurality of signals each representing a single segmental displacement of said cloth frame in at least one of said first and second coordinate directions, said plurality of signals and said plurality of single segmental displacements occasioned thereby representing said predetermined pattern to be embroidered, and control means responsive to said plurality of signals from said sewing pattern storage means for actuating said first and second drive means, said control means including centering control means responsive to said plurality of signals in said storage pattern means and having an output for driving said first and second drive means to segmentally move said cloth frame and the fabric to be embroidered to effect movement of the needle relative to the fabric to be embroidered around the periphery of the predetermined pattern to be embroidered subsequent to the fabric in the cloth frame being manually centered under said needle with respect to the desired central position of the predetermined pattern to be embroidered.

23. An embroidery machine for embroidering a predetermined pattern on fabric as defined in claim 22 wherein said centering control means further includes a needle inhibit circuit for inhibiting energization of said motor and reciprocation of said needle during movement of said cloth frame in response to said centering control means to allow said needle to move relative to the fabric around the periphery of the predetermined pattern without said needle stitching.

24. An embroidery machine for embroidering a predetermined pattern on fabric as defined in claim 22 wherein said reciprocating needle is driven at a substantially constant speed by said motor and said control means further includes a fabric speed control means for varying the speed of movement of said cloth frame by said first and second drive means during the stitching of successive segments of the predetermined pattern to vary the density of stitches in said predetermined pattern.

25. An embroidery machine for embroidering a predetermined pattern on fabric as defined in claim 22 wherein said predetermined pattern to be stitched comprises a plurality of distinct spaced-apart patterns and further including spacing control means for varying the spacing between said distinct pattern in both of said first and second coordinate directions.

26. An embroidery machine for embroidering a predetermined pattern on fabric as defined in claim 22 further including starting control means for moving said cloth frame to position said needle adjacent to the desired starting position on the fabric at which the stitching of the predetermined pattern is initiated subsequent to the fabric and said cloth frame being manually centered with respect to said needle at the desired center of the predetermined pattern.

27. An embroidery machine for embroidering a predetermined pattern on fabric as defined in claim 25 further including starting control means for moving said cloth frame to position said needle adjacent to the desired starting position on the fabric at which the stitching of the predetermined pattern is initiated subsequent to the fabric and said cloth frame being manually centered with respect to said needle at the desired center of the predetermined pattern.

28. An embroidery machine for embroidering a predetermined design on fabric having at least first and second distinct spaced-apart portions comprising a sewing head having a reciprocating needle driven by a motor, a cloth frame for supporting fabric to be embroidered with said predetermined pattern for movement relative to said sewing head, first and second drive means for moving said cloth frame segmentally in first and second coordinate directions, respectively, to enable the sewing head to segmentally embroider a predetermined pattern on the fabric supported by said cloth frame, sewing pattern storage means for storing a plurality of signals each of which is representative of an incremental coordinate displacement of said cloth frame corresponding to individual segments of said predetermined pattern to be embroidered, said plurality of segments each representing a single segmental displacement of said cloth frame in at least one of said first and second coordinate directions, said plurality of signals and said plurality of single segmental displacements occasioned thereby representing said predetermined pattern to be embroidered, and control means responsive to said plurality of signals from said sewing pattern storage means for actuating said first and second drive means, said control means including spacing control means responsive to said plurality of signals in said sewing pattern storage means for establishing the maximum height and width of each of said first and second distinct spaced-apart portions of said predetermined pattern to be embroidered and actuating said first and second drive means to move said cloth frame and inhibit the reciprocation of the needle to space apart said first and second distinct spaced-apart portions of said predetermined pattern, in dependence upon the maximum height and width of each of said first and second distinct spaced-apart portions of said predetermined pattern to be embroidered and the desired spacing between said first and second distinct spaced-apart portions of the pattern to be embroidered, said spacing control being operable to vary the spacing between said first and second distinct spaced-apart portions of said predetermined pattern in both said first and second coordinate directions.

29. An embroidery machine for embroidering a predetermined design on fabric as defined in claim 28 wherein said motor drives said reciprocating needle at a substantially constant speed and said control means further includes a fabric speed control means for varying the speed of movement of said cloth frame by said first and second drive means during the stitching of successive segments of the predetermined pattern to vary the density of stitches in said predetermined pattern.

30. An embroidery machine for embroidering a predetermined pattern on fabric as defined in claim 29 further including starting control means for segmentally moving said cloth frame and the fabric to position said needle adjacent to the desired starting position on the fabric at which the stitching of the predetermined pattern in initiated subsequent to the fabric and said cloth frame being manually centered with respect to said needle at the desired center of the predetermined pattern.

31. An embroidery machine for embroidering a predetermined design on fabric having at least first and second distinct spaced-apart portions comprising a sewing head having a reciprocating needle driven by a motor, a cloth frame for supporting fabric to be embroidered with said predetermined pattern for movement relative to said sewing head, first and second drive means for moving said cloth frame segmentally in first and second coordinate directions, respectively, to enable the sewing head to segmentally embroider a predetermined pattern on the fabric supported by said cloth frame, sewing pattern storage means for storing a plurality of signals each of which is representative of an incremental coordinate displacement of said cloth frame corresponding to individual segments of said predetermined pattern to be embroidered, said plurality of segments each representing a single segmental displacement of said cloth frame in at least one of said first and second coordinate directions, said plurality of signals and said plurality of single segmental displacements occasioned thereby representing said predetermined pattern to be embroidered, and control means responsive to said plurality of signals from said sewing pattern storage means for actuating said first and second drive means, said control means including spacing control means responsive to said plurality of signals in said sewing pattern storage means for actuating said first and second drive means to move said cloth frame and inhibit the reciprocation of the needle to space apart said first and second distinct spaced-apart portions of said predetermined pattern, said spacing control being operable to vary the spacing between said first and second distinct spaced-apart portions of said predetermined pattern in both said first and second coordinate directions, said motor being operable to drive said reciprocating needle at a substantially constant speed and said control means including a fabric speed control means for varying the speed of movement of said cloth frame by said first and second drive means during the stitching of successive segments of the predetermined pattern to vary the density of stitches in said predetermined pattern, starting control means for segmentally moving said cloth frame and the fabric to position said needle adjacent to the desired starting position on the fabric at which the stitching of the predetermined pattern is initiated subsequent to the fabric and said cloth frame being manually centered with respect to said needle at the desired center of the predetermined pattern, scaler means for operating on said plurality of signals from said sewing pattern storage means for modifying the size of the predetermined pattern to be embroidered by modifying the number of segments occasioned in said predetermined pattern by each of said plurality of signals and smoothing means responsive to said plurality of signals for modifying the segmental displacement of said cloth frame in accordance with said scaler means to prevent the exaggeration of jagged edges of the design upon a change of the size of the predetermined pattern as representative by a plurality of signals in said sewing pattern storage means.

32. An embroidery machine for embroidering a predetermined design on fabric as defined in claim 31 further including sensing means for sensing the direction and coordinate displacement of a plurality of sequential segmental displacements of said predetermined pattern as indicated by said plurality of signals prior to embroidering said plurality of segments occasioned by said plurality of signals and inhibit means for inhibiting said smoothing means upon said sensing means sensing a predetermined condition.

* * * * *